US005497586A

United States Patent [19]

Dodd et al.

[11] Patent Number: 5,497,586

[45] Date of Patent: Mar. 12, 1996

[54] FRAMED GLAZING UNIT

[75] Inventors: Graham S. Dodd, Lymm, United Kingdom; Mario Marinoni, Magenta, Italy

[73] Assignees: Pilkington Glass Limited, United Kingdom; Societa Italiana Progetti Srl, Italy

[21] Appl. No.: 183,433

[22] Filed: Jan. 19, 1994

[30] Foreign Application Priority Data

Jan. 21, 1993 [DE] Germany ..... 43 01 592.1

[51] Int. Cl.[6] ..... E06B 7/12

[52] U.S. Cl. ..... 52/172; 52/786.13; 52/788.1; 49/413; 49/501

[58] Field of Search ..... 49/501, 413, 386, 49/388, 396; 52/172, 788, 790, 786.13, 788.1; 428/34

[56] References Cited

U.S. PATENT DOCUMENTS

| | | | |
|---|---|---|---|
| 2,799,063 | 7/1957 | Miller | 49/503 X |
| 3,827,184 | 8/1974 | Pennec et al. | 49/413 X |
| 4,223,482 | 9/1980 | Barroero et al. | 49/501 X |
| 4,416,086 | 11/1983 | Niekrasz | 49/501 X |
| 4,468,905 | 9/1984 | Cribben | 52/172 |
| 4,551,364 | 11/1985 | Davies | 428/34 |
| 4,680,206 | 7/1987 | Yoxon et al. | 428/34 |
| 4,689,853 | 9/1987 | Marinoni . | |
| 4,753,043 | 6/1988 | Bockwinkel | 49/501 |
| 4,808,452 | 2/1989 | McShane | 428/34 |
| 4,817,585 | 4/1989 | Craver | 52/790 X |
| 4,950,344 | 8/1990 | Glover et al. | 428/34 X |

FOREIGN PATENT DOCUMENTS

| | | |
|---|---|---|
| 3425765 | 1/1876 | Germany . |
| 1103528 | 3/1961 | Germany . |
| 2411082 | 9/1975 | Germany . |
| 8125224.2 | 1/1982 | Germany . |
| 8318000 | 10/1983 | Germany . |
| 3516875 | 11/1986 | Germany . |
| 3546692 | 4/1987 | Germany . |
| 8630275.2 | 1/1988 | Germany . |
| 2116243 | 9/1983 | United Kingdom . |

*Primary Examiner*—Carl D. Friedman
*Assistant Examiner*—Christopher Todd Kent
*Attorney, Agent, or Firm*—Burns, Doane, Swecker & Mathis

[57] ABSTRACT

The invention relates to a door, a fanlight, door side section (door side light), window or similar, characterised by two glass sheets arranged beside one another at a distance, by a frame holding the sheets at a distance from one another—preferably incorporating fittings for the door etc., said frame essentially being covered by the sheets, by sealing means for the hermetic sealing of the space enclosed by frame between sheets and by a dessicant communicating with this space.

21 Claims, 6 Drawing Sheets

FRAMED GLAZING UNIT

BACKGROUND TO THE INVENTION

The invention relates to a framed glazing unit, and in particular to such a unit which is openable such as a door, especially a door that is commonly referred to as an all-glass door, or a window, or to such a unit which is fixed and mounted in a glazing assembly adjacent to or in the vicinity of a door or a window and may incorporate hinge, lock, closer, stay or stop fittings, such as a transom panel (otherwise referred to as a fanlight), a door side panel (otherwise referred to as a door side section or a door side light), or similar.

Such an all-glass door of known construction normally consists, apart from its fittings, solely of a glass sheet. Known doors of this type have compact glass sheets. In many cases, the thermal conductivity of such doors is unacceptably high. The same applies to door side sections, fanlights, windows or similar.

SUMMARY OF THE INVENTION

An aim of the invention is to provide a framed glazing unit, such as a door of this kind or a correspondingly designed fanlight, transom panel, door side section , door side panel, door side light, window or similar (hereinafter referred to as a "door etc") whose thermal conductivity is comparatively low relative to known framed glazing units and which can thus be used in an energy-saving manner.

The present invention provides a framed glazing unit for forming a door, window, transom panel or door side panel, the unit comprising two sheets of glazing material arranged in spaced relation beside one another, a peripheral frame holding the sheets at a distance from one another and enclosing a space between the sheets, sealing means for hermetically sealing the space and a dessicant communicating with the space, said frame being covered by the sheets and being adapted to support fittings for mounting the unit so as to comprise an openable door or window or a fixed transom panel or door side panel of a glazing assembly.

The framed glazing unit preferably has mounted on the frame thereof fittings such as hinges, locks, closers, stays or stops or components thereof.

In one preferred embodiment of the invention there is provided a door etc. which is characterised by two glass sheets arranged at a distance from one another, by the frame that holds the sheets at a distance from one another, preferably incorporating fittings for the door, said frame being covered essentially by the sheets, by sealing means for hermetically sealing the space enclosed by the frame between the sheets and by a dessicant communicating with this space. Preferably, the dessicant is provided in chambers along the inner side of the frame communicating with the space, preferably by perforations in the walls facing the space.

Toughened glass, tempered glass, safety glass and synthetic glass are particularly preferred as the glass. Alternatively, plastics sheets may be used as the glazing sheets.

One advantage of the invention is that the frame between the two sheets, unlike a normal frame, does not have to be bearing element for the door panel etc. Instead as is common with all-glass doors, all the sheets are self-supporting, whilst the frame is preferably non-supporting.

In order to accommodate a relative thermal expansion between the frame and the sheets, the door etc. is preferably characterised by the fact that the sheets and the frame have holes lying in a line outside the space sealed by the frame, through which screw elements pass which are segregated from the sheets and the frame and which press the sheets against the frame.

However, in order to be able to press the sheets firmly against the frame, the door etc. is preferably characterised by the fact that, for the purpose of segregation, the screw elements are separated by a distance from the internal peripheral faces of the holes in the sheets and in the frame and that seals made of fibres and/or plastic are positioned between the sheets and the areas of the screw elements exerting pressure on the sheets.

A particularly good seal between the side faces of the frame and the faces of the sheets facing opposite them is achieved if the side faces of the frame are glued to the faces of the sheets facing opposite them, preferably by means of sealing double-sided adhesive strips.

The seal is further enhanced if the frame has sides with a cross-section in the shape of a T whose transverse webs lie adjacent, via seals, to the peripheral faces of the sheets.

Tests have shown that the thickness of the sheets should preferably be between 4 mm and 12 mm, and more preferably between 6 mm and 8 mm, that the distance between the sheets should amount to between 13 mm and 19 mm, preferably between 15 mm and 17 mm, especially 16 mm, and that the frame should have a box section of width between 75 mm and 85 mm, preferably between 77 mm and 83 mm, and a wall thickness of between 2 mm and 4 mm, preferably between 2.5 mm and 3.5 mm.

In order to attach fittings, the door etc. is preferably characterised by the fact that there are holes in the frame and in the sheets for the purpose of attaching fittings. The fittings may comprise hinges, locks, closers, stays or stops, or components of such devices.

Thus, the fittings are then essentially arranged between the sheets, which does not present any major difficulties with the dimensions stated for the box section.

In order to make the frame particularly rigid at its corners, especially for accommodating fittings, the door etc. is preferably characterised by the fact that the frame has corner pieces preferably made from cast metal which are fitted in a sealed fashion into its sides and which accommodate fittings.

A particularly simple form of embodiment of the door etc., based on the traditional structure, is characterised by the fact that the frame is formed by one or more elongated spacers containing a dessicant and that the corners of the sheets and correspondingly the corners of the frame are cut away to accommodate fitting shoulders.

BRIEF DESCRIPTION OF THE DRAWINGS

Embodiments of the present invention, relating to doors, are described hereinafter with reference to the accompanying drawings. (Fanlights, transom panels, door side sections, door side panels, door side lights, windows or similar in accordance with further embodiments of the invention may be designed in a corresponding manner).

DETAILED DESCRIPTION OF THE PREFERRED EMBODIMENTS

The same reference numbers refer to the same or essentially the same parts.

Figure 1:
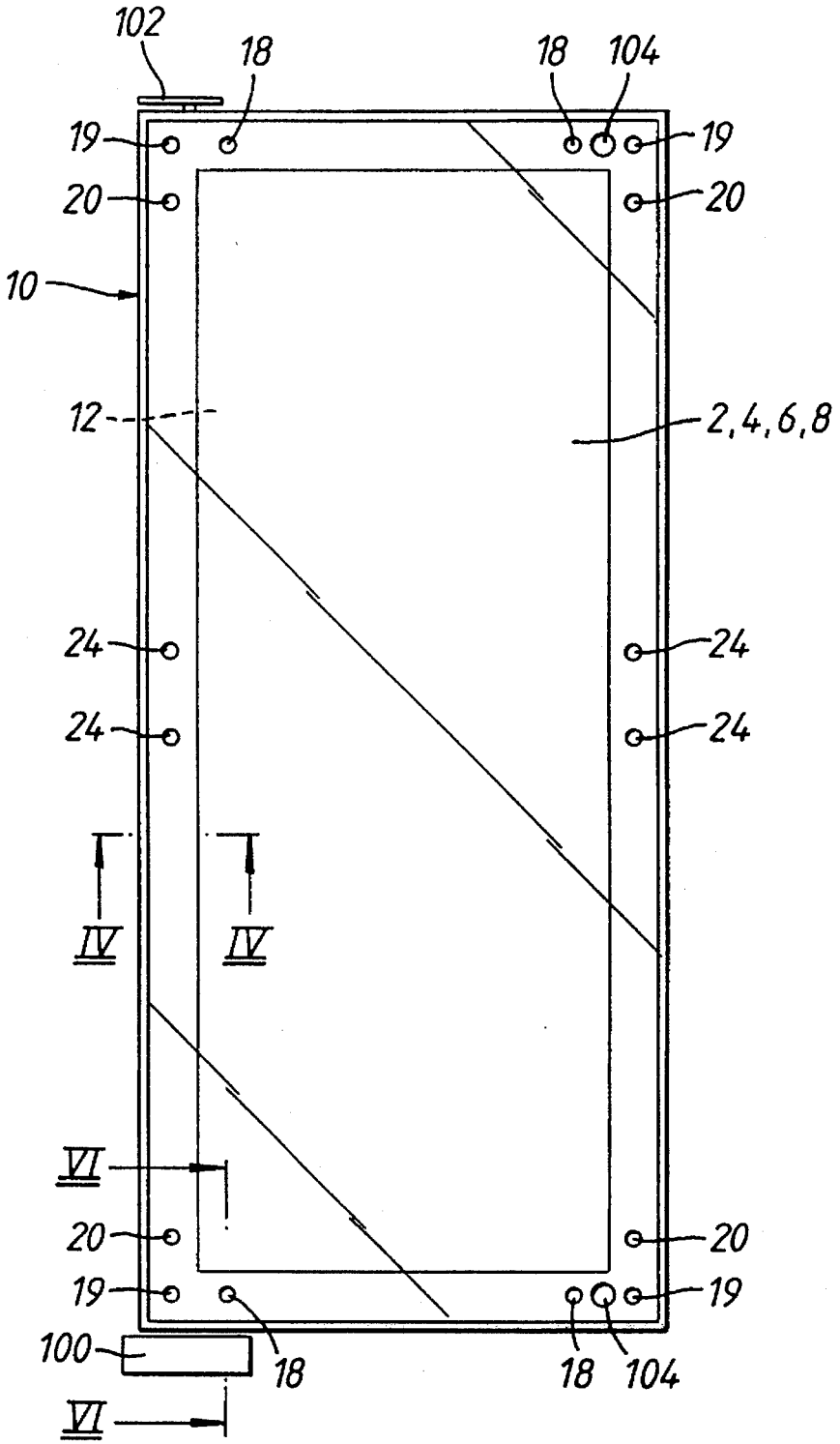
FIG. 1 shows a view of a door.
Figure 2:
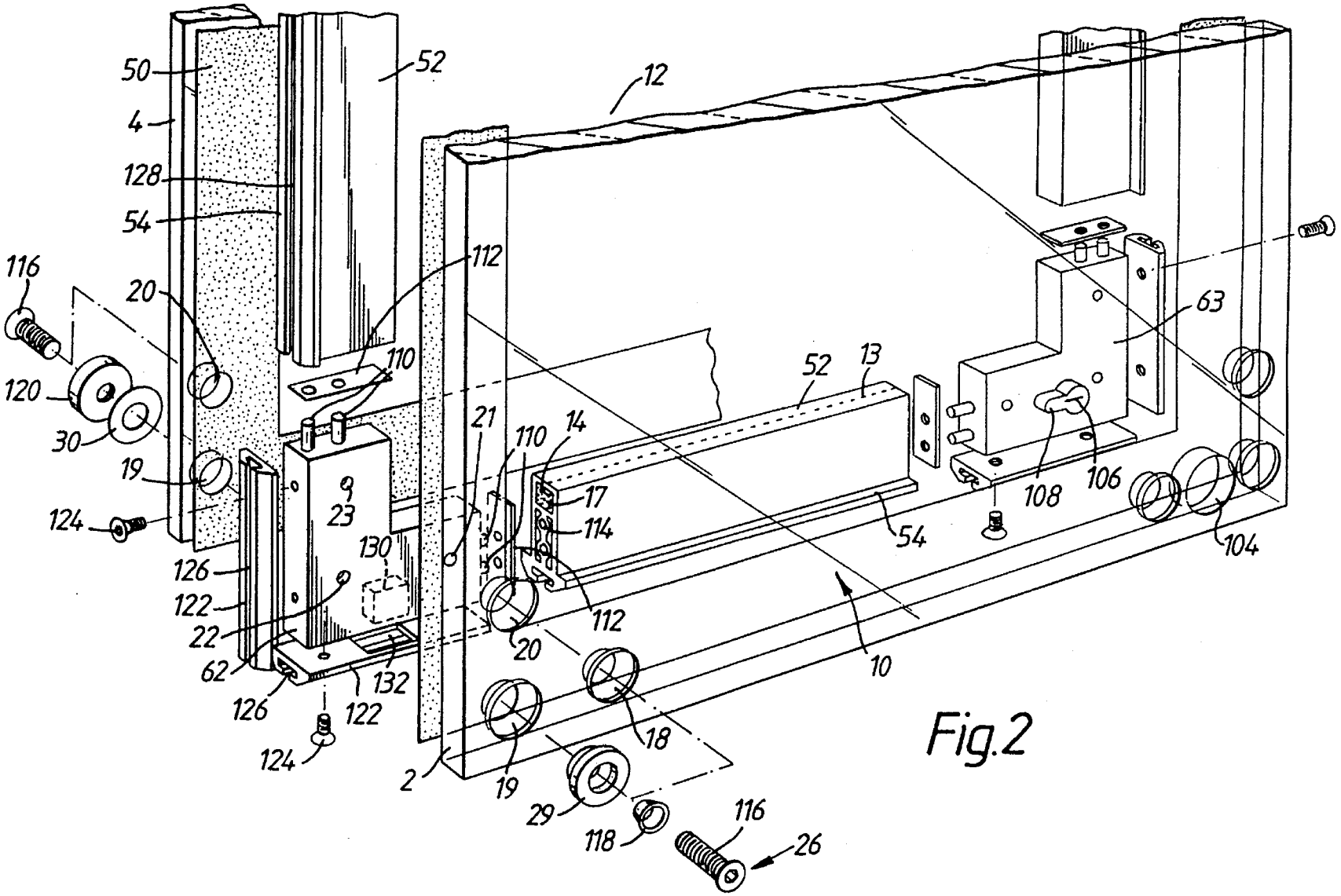
FIG. 2 shows an exploded view of the lower part of a first form of embodiment of a door.

Referring to FIGS. 1 and 2, a door in accordance with a first embodiment of the invention has two glass sheets 2,4 (glass sheets 6,8 in the embodiments of FIGS. 5 and 6) arranged beside one another spaced at a distance and an internal non-supporting frame 10 holds the sheets 2,4 at the prescribed distance from one another. In addition, the frame 10 seals off the space 12 encompassed by it between the sheets. The frame 10 contains chambers 14 communicating with the space 12 through perforations 13, a dessicant 17 being provided in said chambers. The sheets 2,4 and the frame 10 have holes 18,19,20 and 21,22,23 lying in a line outside the chambers 14, through which are passed screw elements 26 respectively which press sheets 2,4 against frame 10. For clarity of illustration, only one screw element is shown in FIG. 2 on each side of the door. These screw elements 26 are segregated from the sheets 2,4 and the frame 10. To achieve this, the screw elements 26 stand at a distance from the internal peripheral circumferential faces of the holes 18,19,20 and 21,22,23 in the sheets 2,4 and the frame 10.

Figure 4:
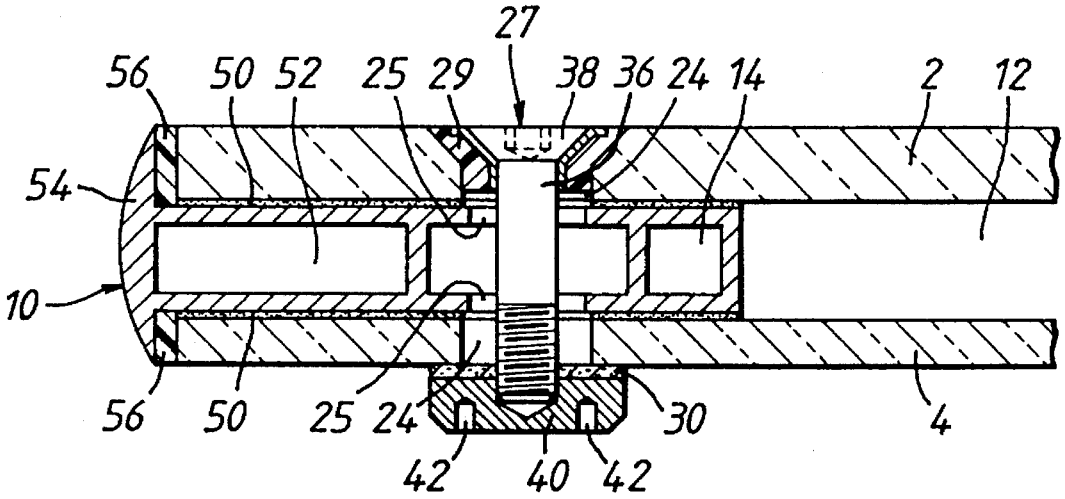
FIG. 4 shows a section IV—IV in FIG. 1 in a third form of embodiment.

Seals 29,30 are arranged between the sheets 2,4 and the faces of screw elements 26 exerting pressure on sheets 2,4. Seals 29 are made from plastic and seals 30 from fibrous material. Further holes 24,25 lying in a line outside the chambers 14 are provided mid-way up the sheets 2,4 and the frame 10, the holes 24 being shown in FIG. 1. As shown in FIG. 4, screw elements 27 pass through the holes 24,25 and are separated therefrom by seals 29 and 30. The screw elements 27 according to FIG. 4 comprise a screw 36 with a countersunk head 38 (hole 24 is suitably conical) and a nut 40 supported from the outside on sheet 4 and having blind holes 42 into which a tool can fit.

In the case of the door according to FIG. 1, a floor closer 100 is shown diagrammatically at the bottom left and a swivelling pivot bearing 104 is shown top left. Cylindrical holes 104 are shown at the bottom right and the top right through which keyholes 106 of safety locks 108 (FIG. 2) are accessible.

FIG. 2 shows that the frame 10 comprises solid end pieces 62,63 which are substantially L-shaped corner pieces with male parts in the form of lugs 110 pointing to side pieces 52 of the frame 10, which lugs can be inserted via sealing plates 112 into cooperating female parts in the form of insertion sockets 114 which are provided in the side pieces 52.

The side faces of frame 10 are glued to the side faces of sheets 2,4 facing towards them by means of sealing double-sided adhesive strip 50 (such as Scotch tape, "Scotch" being a Registered Trade Mark).

The side pieces 52 of the frame 10 have a cross-section in the shape of a T whose transverse web 54 lies adjacent, via seals 56, to the peripheral faces of sheets 2,4. The transverse web includes a channel, preferably a dovetailed channel, 126 for receiving a peripheral seal.

The screw elements 26 according to FIG. 2 consists of three pairs of two countersunk screws 116 in each, which are to be screwed from both sides of the door through a metal bush 118 or a metal washer 120 and a seal 29 comprising a plastic packing ring or a seal 30 comprising a fibre material packing ring into holes 21,22 and 23 in the frame end pieces 62,36, for which purpose these holes are provided with internal threads. To the outer faces of end pieces 62 and 63 are screwed, by means of countersunk screws 124, rail pieces 122 in whose outer face there is a dovetailed section 126 to accommodate an all-round seal. The outer faces of the transverse webs 54 of the side pieces 52 are provided with corresponding dovetailed sections 128 which lie flush to the dovetailed sections 126.

At the bottom in corner piece 62 there is a blind hole 130, rectangular in cross-section, into which a correspondingly shaped pivot of the floor closer 100 can be inserted via a recess 132 in the rail piece 122. Correspondingly, a safety lock 108 is inserted into the corner piece 63.

In the form of embodiment according to FIG. 2, chambers 14 are integral with the side pieces 52.

Figure 3:
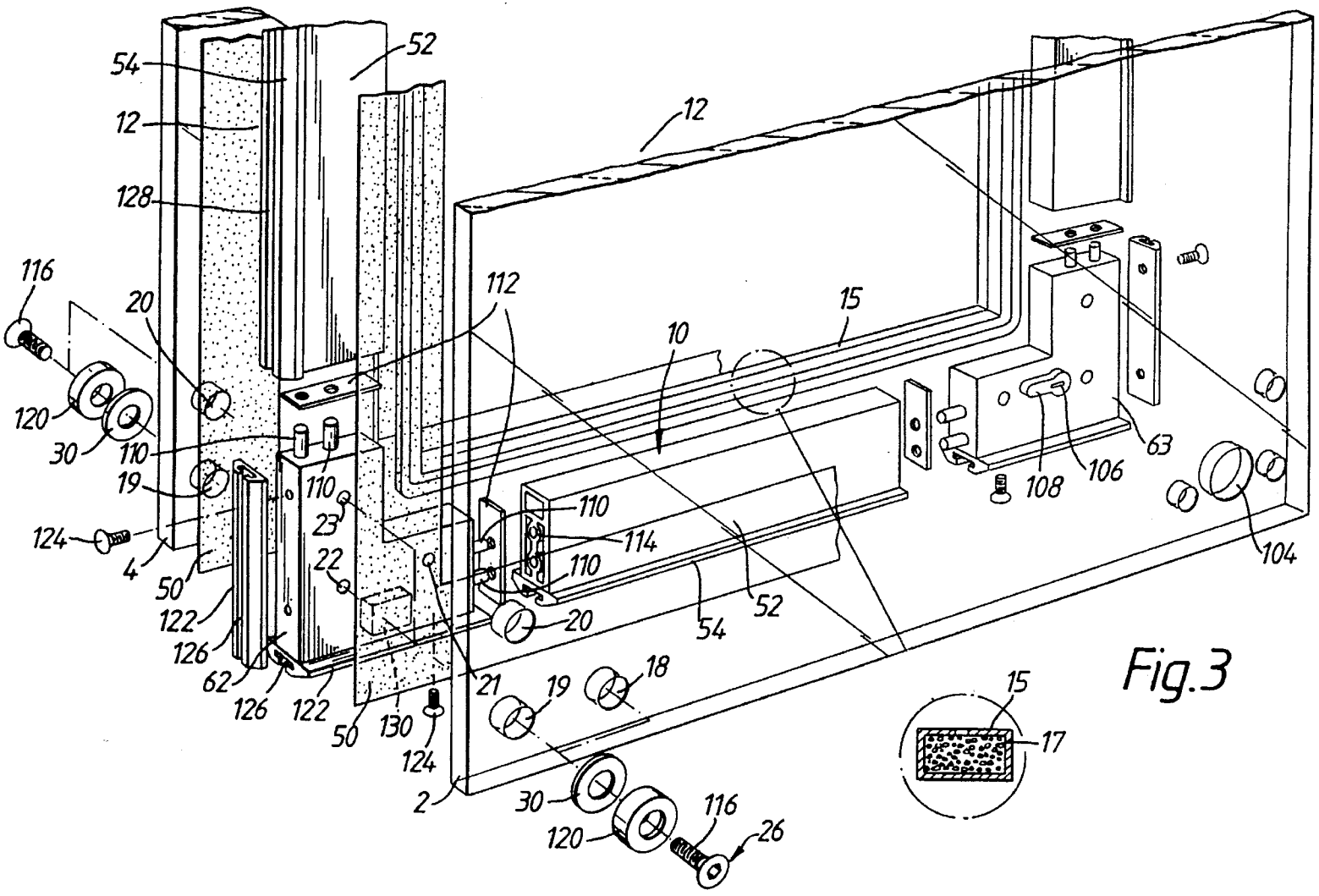
FIG. 3 shows a second form of embodiment corresponding to FIG. 2.

In the form of embodiment according to FIG. 3, which is a modification of that of FIG. 2, chambers 15 are provided instead of chambers 14 and chambers 15 are formed into a separate frame which runs all round the frame 10 at a small distance from the side pieces 52.

Figure 5:
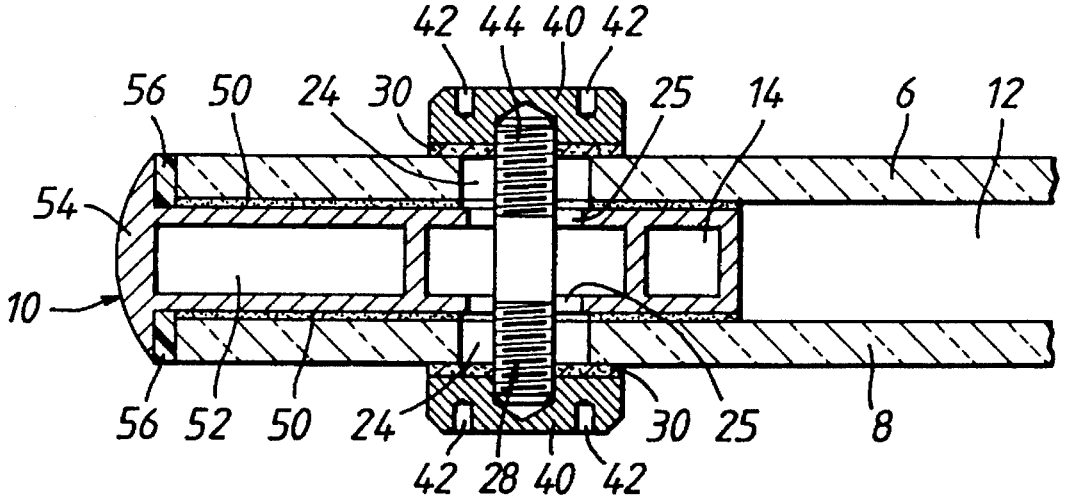
FIG. 5 shows a section IV—IV in FIG. 1 in a fourth form of embodiment.

As shown in FIG. 4, sheet 2 may have a greater thickness than that of sheet 4. FIG. 5 is a modification of FIG. 4 wherein, instead of screw elements 27, there are provided screw elements 28 comprising a bolt 44 with terminal threads onto which nuts 40 are screwed, such as those described in connection with FIG. 4. In addition, in the FIG. 5 embodiment sheets 6,8 are provided instead of sheets 2,4, sheets 6,8 having the same thickness.

Figure 6:
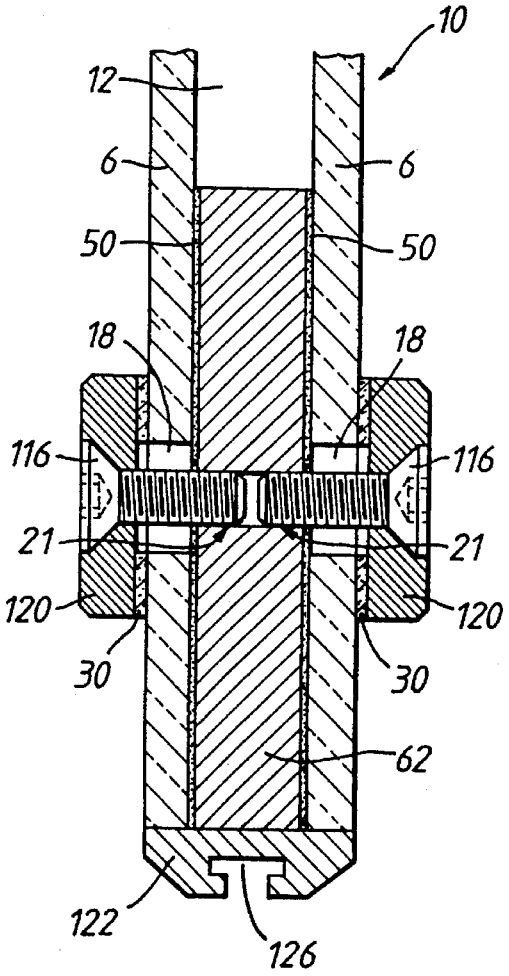
FIG. 6 shows a section VI—VI in FIG. 1 in a fifth form of embodiment.

FIG. 6 shows in detail the screw assemblies of FIG. 3 in which screws 116 are screwed through the glass sheets 6,8 into the end pieces 62 and pass through metal washers 120 and seals 30 on both sides of the frame 10. In the FIG. 6 embodiment, sheets 6,8 are provided which have the same thickness.

Figure 7:
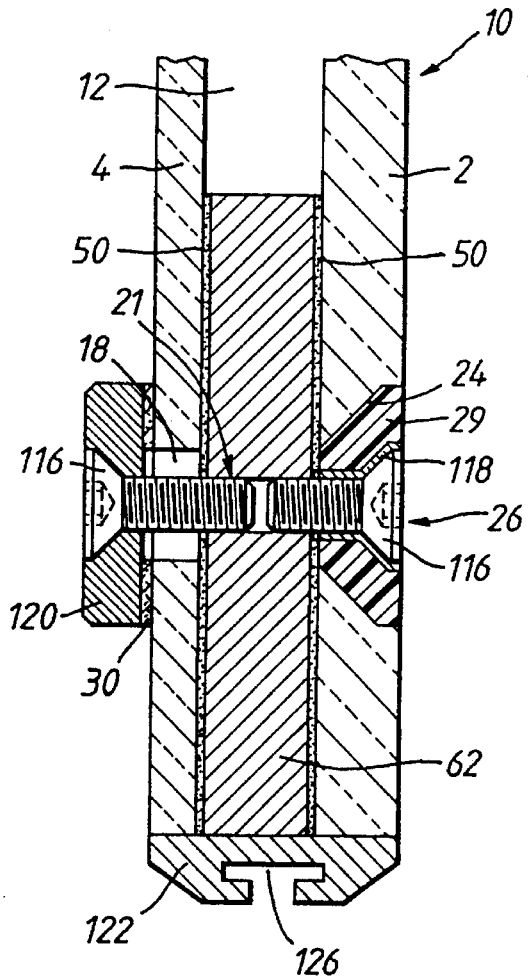
FIG. 7 shows a section VI—VI in FIG. 1 in a sixth form of embodiment.

FIG. 7 shows in detail the screw assemblies of FIG. 2 in which on one side of the frame 10 screws 16 are screwed though the glass sheet 2 into the end piece 62 via metal bush 118 and seal 29 and on the other side of the frame 10 screws 116 are screwed through the glass sheet 4, metal washers 120 and seal 30 into the end piece 62. In the FIG. 7 embodiment, sheets 2,4 are provided in which sheet 2 is thicker than sheet 4.

In the form of embodiment according to FIGS. 4 and 7, the thickness of sheet 2 is 10 mm and the thickness of sheet 4 is 6 mm. In the form of embodiment according to FIGS. 5 and 6, the thickness of both sheets 6,8 is 6 mm. The distance between sheets 2,4 and 6,8 is preferably 16 mm. After many tests, this has proved to be particularly advantageous, also bearing in mind the heat circulation of the air in space 12.

Frame 10 has a box section preferably with a width of 80 mm and a wall thickness of 3 mm. This is particularly advantageous with regard to the accommodation of door fittings in the box section of frame 10.

Figure 8:
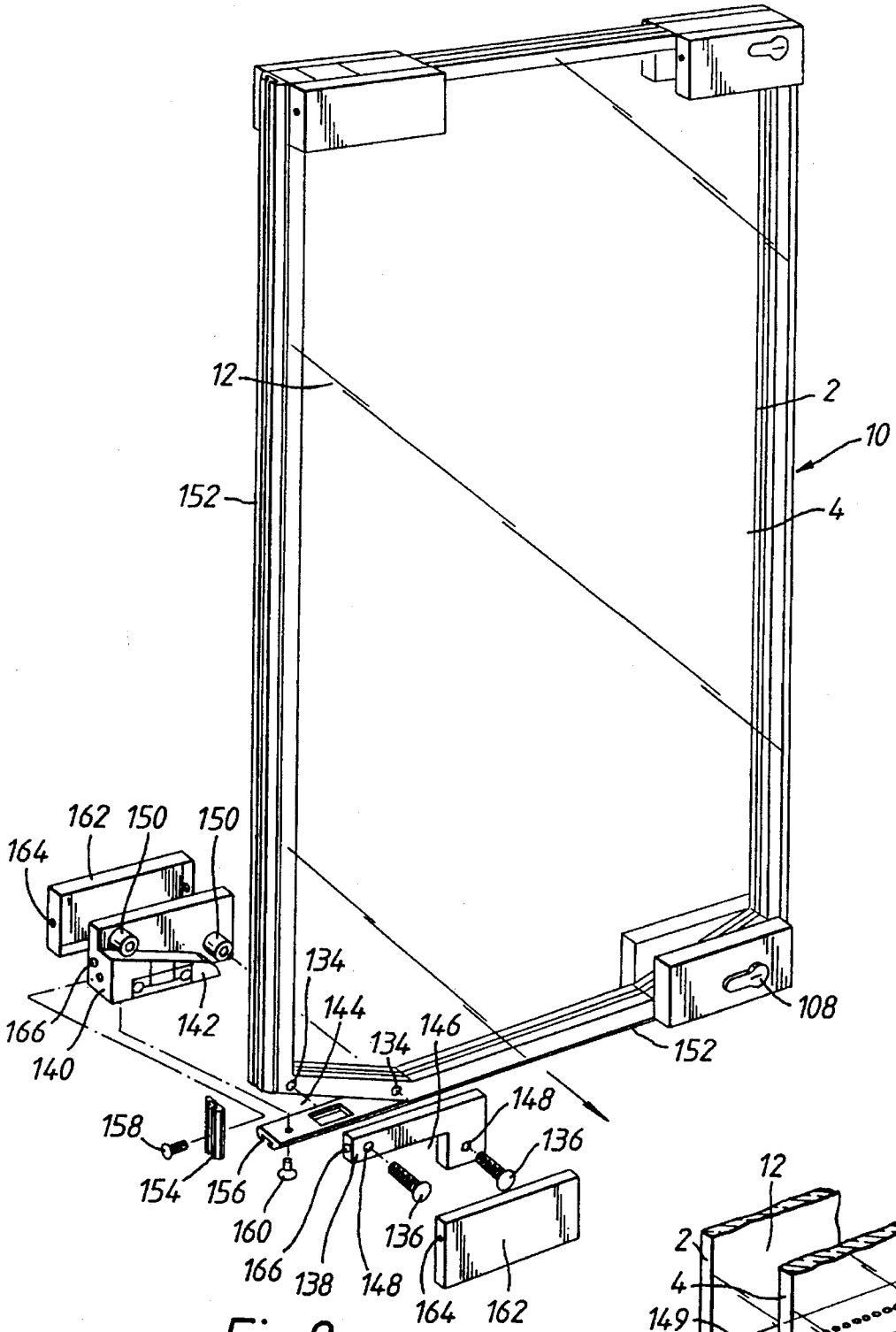
FIG. 8 shows an exploded view of a seventh form of embodiment of a door.
Figure 9:
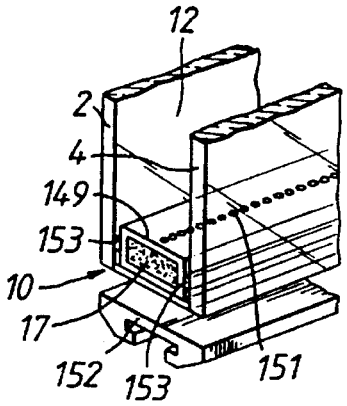
FIG. 9 shows an enlarged view of part of the door of FIG. 8.

With reference to the embodiment of FIGS. 8 and 9, a door 10 has two sheets 2,4 which are held at a distance from one another via seals 153 by a frame 10 formed by an elongated spacer 149 containing dessicant 17, the walls of said frame facing space 12 being perforated with perforations 151.

The corners of sheets 2,4 and the frame 10 are cut away in order to accommodate fittings. In the area of the cut-aways, the sheets 2,4 and the frame 10 have holes 134 through which countersunk screws 136 are inserted for the purpose of attaching fittings 138,140. The fitting 140 is provided with a projecting area 142 which is accommodated in a recess 144 left free by the cut-away and in a recess 146 left free by the other fitting 138.

The screws 136 penetrate holes 148 in the fitting 138, before they penetrate the holes 134, and they are screwed into the internally threaded parts 150 of fitting 140.

A peripheral seal (not shown) that encompasses sheets 2,4 and the frame 10, is carried by seal-mounting side sections 152, top and bottom sections 156 and side corner sections 154, each section being dovetailed.

The sections 154,156 are screwed down to fitting part 140 by means of countersunk screws 158,160. The fittings 138,140 are covered on the outside by caps 162 which can be fitted onto projections 166 on fittings 138,140 by means of edge perforations 164 provided in them.

Figure 10:
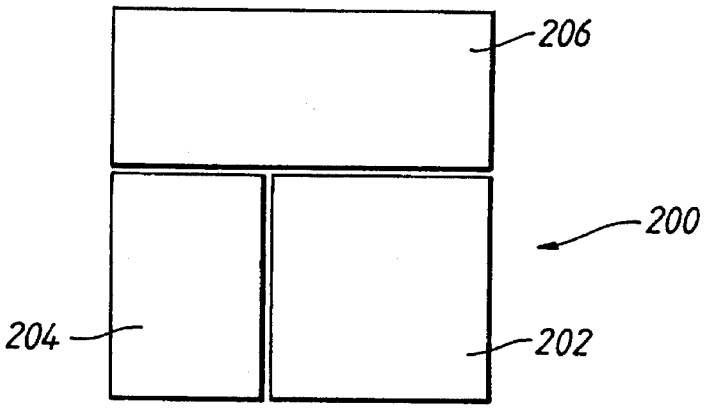
FIG. 10 shows a glazing assembly incorporating a door, a transom panel and a door side panel, all constructed of framed glazing units in accordance with the present invention.

FIG. 10 shows a glazing assembly 200 formed from glazing units in accordance with the present invention. The glazing assembly 200 comprises a door 202, a door side panel 204 mounted horizontally adjacent thereto and a transom panel 206 mounted above the door 202 and door side panel 204.

The door 202 may have the construction shown in the preceding FIGS. 1 to 9. The door side panel 204 and the transom panel 206 have the general glass sheet/frame construction illustrated in FIGS. 1 to 9. The door side panel 204 may have mounted thereon fittings for a door, such as lock, closer or stop fittings and the transom panel 206 may have hinge, lock, closer or stop fittings mounted thereon. Such fittings are, as described with reference to FIGS. 1 to 9, mounted on the frame of the glazing unit.

In alternative glazing assemblies in accordance with the present invention, the transom panel may extend only over the width of the door and the side panel may extend upwardly so as to be horizontally adjacent to the transom panel. Alternatively, the transom panel may be split so as to have two panels, one above the door and one above the door side panel. In further alternatively arrangements, two adjacent doors may be provided, featuring either a full-height or door-height side panel and there being either a transom panel either extending over the full width of the opening of the doors or split transom panels extending over either the width of a respective door or the width of a respective door and the adjacent side panel.

What we claim is:

1. A flamed glazing unit for forming a door, window, transom panel or door side panel, the unit comprising two sheets of glazing material arranged in spaced relation beside one another, a peripheral frame holding the sheets at a distance from one another and enclosing a space between the sheets, the Sheets and the frame having holes lying outside the space enclosed by the frame, screw elements which pass through the holes and press the sheets against the frame so that the frame is covered by the sheets, sealing means for hermetically sealing the space and a dessicant communication with the space, said frame being adapted to support fittings for mounting the unit.

2. A framed glazing unit according to claim 1 wherein the dessicant is disposed in chambers running along the inside of the frame and communicating with the space by means of perforations in frame walls of the chambers facing the space.

3. A framed glazing unit according to claim 1 wherein the screw elements are separated from the sheets and the frame by being located inwardly from the internal faces of the holes in the sheets and the frame further comprises seals made of one of fibers and plastics which are positioned between the sheets and the faces of the screw elements exerting pressure on the sheets.

4. A framed glazing unit according to claim 1 wherein the sealing means includes gluing means for gluing the side faces of the frame to the faces of the sheets facing them.

5. A framed glazing unit according to claim 4 wherein the gluing means comprises double-sided adhesive strips.

6. A framed glazing unit according to claim 1 wherein the frame has side pieces with a cross-section in the form of a T thereby defining a transverse web which lies adjacent, via an elongated seal, to the peripheral edges of the sheets.

7. A framed glazing unit according to claim 6 wherein the transverse web includes a channel for receiving a peripheral seal.

8. A framed glazing unit according to claim 1 wherein the thickness of the sheets is from 4 mm to 12 mm.

9. A framed glazing unit according to claim 8 wherein the thickness of the sheets is from 6 mm to 8 mm.

10. A framed glazing unit according to claim 1 wherein the distance between the sheets is from 13 mm to 19 mm.

11. A framed glazing unit according to claim 10 wherein the distance between the sheets is from 15 mm to 17 mm.

12. A framed glazing unit according to claim 11 wherein the distance between the sheets is 16 mm.

13. A framed glazing unit according to claim 1 wherein the frame has a box section of width from 75 mm to 85 mm and a wall thickness from 2 mm to 4 mm.

14. A framed glazing unit according to claim 13 wherein the frame has a box section of width from 77 to 83 mm and a wall thickness of from 2.5 to 3.5 mm.

15. A framed glazing unit according to claim 1 wherein the holes are provided in the frame and in the sheets at adjacent corners of the unit and further comprising fittings for mounting the unit in a building, the fittings being attached to the unit by screw elements passing through the holes.

16. A framed glazing unit according to claim 1 wherein the frame has corner pieces assembled in a sealed fashion to side pieces of the frame, said corner pieces accommodating fittings.

17. A framed glazing unit according to claim 16 wherein the corner pieces are substantially L-shaped and are assembled to the side pieces by co-operating male and female parts.

18. A framed glazing unit according to claim 1 wherein at least one fitting selected from a hinge, a lock, a closer, a stay and a stop is mounted on the frame.

19. A framed glazing unit according to claim 18 wherein the at least one fitting is mounted between and is covered by the glass sheets.

20. A framed glazing unit according to claim 1 wherein the frame is formed by at least one elongated spacer containing a dessicant and the corners of the sheets and corresponding corners of the frame are cut away to accommodate fittings which are attached to the unit at the said corners.

21. An architectural glazing assembly comprising an array of at least two glazing units according to claim 1.

* * * * *